US009309779B2

(12) United States Patent
Toulemonde et al.

(10) Patent No.: US 9,309,779 B2
(45) Date of Patent: Apr. 12, 2016

(54) STEAM TURBINE GOVERNING SYSTEM FOR MAINTAINING SYNCHRONIZATION AND PROCESS FOR PERFORMING THE SAME

(71) Applicant: ALSTOM Technology Ltd, Baden (CH)

(72) Inventors: Martin Toulemonde, Paris (FR); Caroline Jaillot, Levallois-Perret (FR); Denis Rigot, Rosny Sous Bois (FR)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 14/224,439

(22) Filed: Mar. 25, 2014

(65) Prior Publication Data

US 2014/0294561 A1 Oct. 2, 2014

(30) Foreign Application Priority Data

Mar. 29, 2013 (EP) ..... 13161858

(51) Int. Cl.
*F01D 15/10* (2006.01)
*F01D 21/14* (2006.01)

(52) U.S. Cl.
CPC ..... *F01D 21/14* (2013.01); *F05D 2220/31* (2013.01); *F05D 2220/76* (2013.01); *F05D 2270/021* (2013.01); *F05D 2270/024* (2013.01); *F05D 2270/061* (2013.01); *F05D 2270/091* (2013.01); *F05D 2270/16* (2013.01); *F05D 2270/335* (2013.01)

(58) Field of Classification Search
CPC ..... F05D 2220/31; F05D 2220/76; F05D 2270/16; F05D 2270/09; F05D 2270/335
USPC ..... 290/52; 415/10; 60/652, 660
See application file for complete search history.

(56) References Cited

U.S. PATENT DOCUMENTS 3,061,533 A * 10/1962 Shannon et al. ..... 376/219
3,601,617 A * 8/1971 Mello et al. ..... 290/40 C
3,614,585 A 10/1971 Wedin
3,643,437 A * 2/1972 Birnbaum et al. ..... 60/646

(Continued)

FOREIGN PATENT DOCUMENTS

DE 27 08 844 9/1978
DE 28 55 404 7/1980

(Continued)

OTHER PUBLICATIONS

Decision of Grant issued from Russian Patent Office dated Jul. 3, 2015 for RU Application No. 2014109778.

*Primary Examiner* — Julio Gonzalez Ramirez

(57) ABSTRACT

The invention relates to a steam turbine governing system for maintaining synchronization between an electrical grid and an electric generator, driven by a steam turbine, after the occurrence of a grid short circuit at the electrical grid. The governing system includes a governor adapted to control an arrangement of valves for regulating the steam flow in the steam turbine and means for measuring the voltage drop at the output of the electric generator. The governing system further includes means for measuring the electric power drop at the output of the electric generator. The governor is adapted to initiate operation of the arrangement of valves of the steam turbine in response to a voltage drop exceeding a predetermined value and to an electric power drop exceeding a predetermined value.

7 Claims, 4 Drawing Sheets

(56) References Cited

U.S. PATENT DOCUMENTS

| | | | | |
|---|---|---|---|---|
| 4,514,642 | A * | 4/1985 | Ross | 290/40 R |
| 5,547,337 | A * | 8/1996 | Fork et al. | 415/1 |
| 7,804,184 | B2 | 9/2010 | Yuan et al. | |
| 8,498,751 | B2 * | 7/2013 | Meier et al. | 700/287 |

FOREIGN PATENT DOCUMENTS

| | | |
|---|---|---|
| DE | 34 38 452 | 3/1986 |
| DE | 42 17 625 | 12/1993 |
| EP | 1959555 A1 | 8/2008 |
| RU | 2339144 C1 | 11/2008 |

* cited by examiner

STEAM TURBINE GOVERNING SYSTEM FOR MAINTAINING SYNCHRONIZATION AND PROCESS FOR PERFORMING THE SAME

CROSS-REFERENCE TO RELATED APPLICATIONS

This application claims priority to European application 13161858.9 filed Mar. 29, 2013, the contents of which are hereby incorporated in its entirety.

TECHNICAL FIELD

The present invention relates to the field of steam turbines and more particularly to a steam turbine governing system for maintaining synchronization between an electrical grid and an electric generator after the occurrence of a grid short circuit and to a process for performing the same.

BACKGROUND

As it is known in the art, a steam turbine is a device which converts thermal energy of pressurized steam to mechanical energy.

The mechanical energy obtained by a steam turbine may be used for driving a rotor of an electric generator for the production of electrical energy. Particularly, the rotor of the electric generator is driven by means of a turbine shaft that interconnects the above mentioned rotor with the steam turbine.

Commonly, the electric generator is coupled with an alternating current electrical grid (hereinbelow called electrical grid) for distributing the produced electrical energy to the consumers through a plurality of transmission lines. Particularly, in order to obtain a delivery of electrical energy from the electric generator to the electrical grid, it is important that the electric generator and the electrical grid are synchronized such that the frequency of the electric generator matches the frequency of the electrical grid.

However, a grid short circuit in one or more of the transmission lines may occur. In order to clear the grid short circuit, the transmission line at which the latter has occurred is isolated by means of a circuit breaker. The above mentioned event is known as load rejection and results to a drop of electric power at the output of the electric generator. Furthermore, the drop of electric power at the output of the electric generator results to an unbalance between the electrical torque and the mechanical torque of the electric generator. Particularly, the value of the electrical torque of the electric generator becomes smaller than the value of the mechanical torque of the electric generator resulting to an acceleration of the steam turbine. As a result of this acceleration, the frequency of the electric generator becomes higher than the frequency of the electrical grid such that a loss of synchronization between the electric generator and the electrical grid may occur.

In order to prevent such a loss of synchronization, a steam turbine governing system may be used. This system is adapted to maintain the speed of the steam turbine at a speed (known as synchronization speed) wherein the frequency of the electric generator matches the frequency of the electrical grid in order to prevent a loss of synchronization between the electric generator and the electrical grid. Particularly, after the occurrence of a grid short circuit, the steam turbine accelerates and its speed exceeds the synchronization speed such that the frequency of the electric generator becomes higher than the frequency of the electrical grid. The steam turbine governing system serves in regulating the steam turbine speed until the latter returns to the synchronization speed at which the frequency of the electric generator matches the frequency of the electrical grid.

The known steam turbine governing systems comprise a governor for regulating the speed of a steam turbine by regulating the steam flow in the latter. The regulation of the steam flow in the steam turbine is achieved by an arrangement of valves whose operation is initiated on demand of the governor. Particularly, the arrangement of valves is disposed at one or more steam pipes through which the steam is provided by a steam generator to the steam turbine. In order to maintain the above mentioned synchronization after the occurrence of a grid short circuit, the arrangement of valves is activated on demand of the governor in order to limit the speed of the steam turbine when the latter exceeds the synchronization speed.

In one well known type of steam turbine governing systems, the governor regulates the speed of the steam turbine in response to the measurement of the speed of the steam turbine after the occurrence of a grid short circuit. The above mentioned measurement is achieved by a speed sensor being disposed at the turbine shaft. The speed sensor communicates with the governor in order to transfer a speed signal to the latter when the speed of the steam turbine exceeds a value of between 100% and 130% of the synchronization speed. In response to this speed signal, the governor initiates operation of the arrangement of valves which lasts until the speed of the steam turbine becomes equal to the synchronization speed.

In another well known type of steam turbine governing systems, the governor regulates the speed of the steam turbine in response to the measurement of the electric power drop which takes place in case of a load rejection at the output of the electric generator after the occurrence of a grid short circuit. The measurement of the electric power drop may be achieved by means of an electric power sensor being disposed at the output of the electric generator. The electric power sensor communicates with the governor in order to transfer an electric power drop signal to the latter. In response to this electric power drop signal, the governor initiates operation of the arrangement of valves which lasts until the speed of the steam turbine becomes equal to the synchronization speed.

However, the initiation of operation of the arrangement of valves of the above mentioned steam turbine governing systems presents a substantial delay after the occurrence of a grid short circuit. This substantial delay may lead to a loss of synchronization between the electric generator and the electrical grid.

Accordingly, there is a need of improving the current steam turbine governing systems of the prior art in order to ensure the maintenance of the synchronization between the electric generator and the electrical grid after the occurrence of a grid short circuit.

SUMMARY

It is an object of the invention to provide a steam turbine governing system that ensures the maintenance of the synchronization between the electric generator and the electrical grid after the occurrence of a grid short circuit.

It is another object of the present invention to provide a steam turbine governing system which reduces the delay of the initiation of the regulation of the steam turbine speed after the occurrence of a grid short circuit.

These and other objects are achieved by means of the steam turbine governing system of the invention. Particularly, the steam turbine governing system of the invention maintains synchronization between an electrical grid and an electric generator after the occurrence of a grid short circuit at the electrical grid, the electric generator being driven by the steam turbine, and comprises:

a governor adapted to control an arrangement of valves, the valves regulating the steam flow in the steam turbine so that synchronization between the electrical grid and the electric generator is maintained;

means for measuring the voltage drop at the output of the electric generator; and means for measuring the electric power drop at the output of the electric generator.

The governor is connected to the means for measuring the voltage drop and to the means for measuring the electric power drop, both at the output of the electric generator, the governor being further adapted to initiate operation of the arrangement of valves regulating the steam flow in the steam turbine, in response to a voltage drop exceeding a predetermined value of voltage at the output of the electric generator and to an electric power drop exceeding a predetermined value of electric power at the output of the electric generator after the occurrence of the grid short circuit.

The steam turbine governing system of the invention starts operating when a voltage drop exceeds a predetermined value of voltage and a power drop also exceeds a predetermined value of power. Such initiation is faster that that in the prior art, as it will be further explained.

According to another aspect, the invention also provides a process for maintaining synchronization between an electrical grid and an electric generator after the occurrence of a grid short circuit at the electrical grid, the electric generator being driven by the steam turbine, the process comprising the steps of:

measuring the voltage drop at the output of the electric generator, measuring the electric power drop at the output of the electric generator, in parallel;

initiating operation of the arrangement of valves of the steam turbine in response to a voltage drop exceeding a predetermined value of voltage at the output of the electrical generator and an electric power drop exceeding a predetermined value of electric power at the output of the electrical generator in order to maintain the synchronization between the electrical grid and the electric generator after the occurrence of the grid short circuit.

BRIEF DESCRIPTION OF THE DRAWINGS

The above objects and characteristics of the present invention will become apparent by describing an/several embodiments of the present invention in detail with reference to the accompanying drawings, in which.

DETAILED DESCRIPTION

Figure 1:
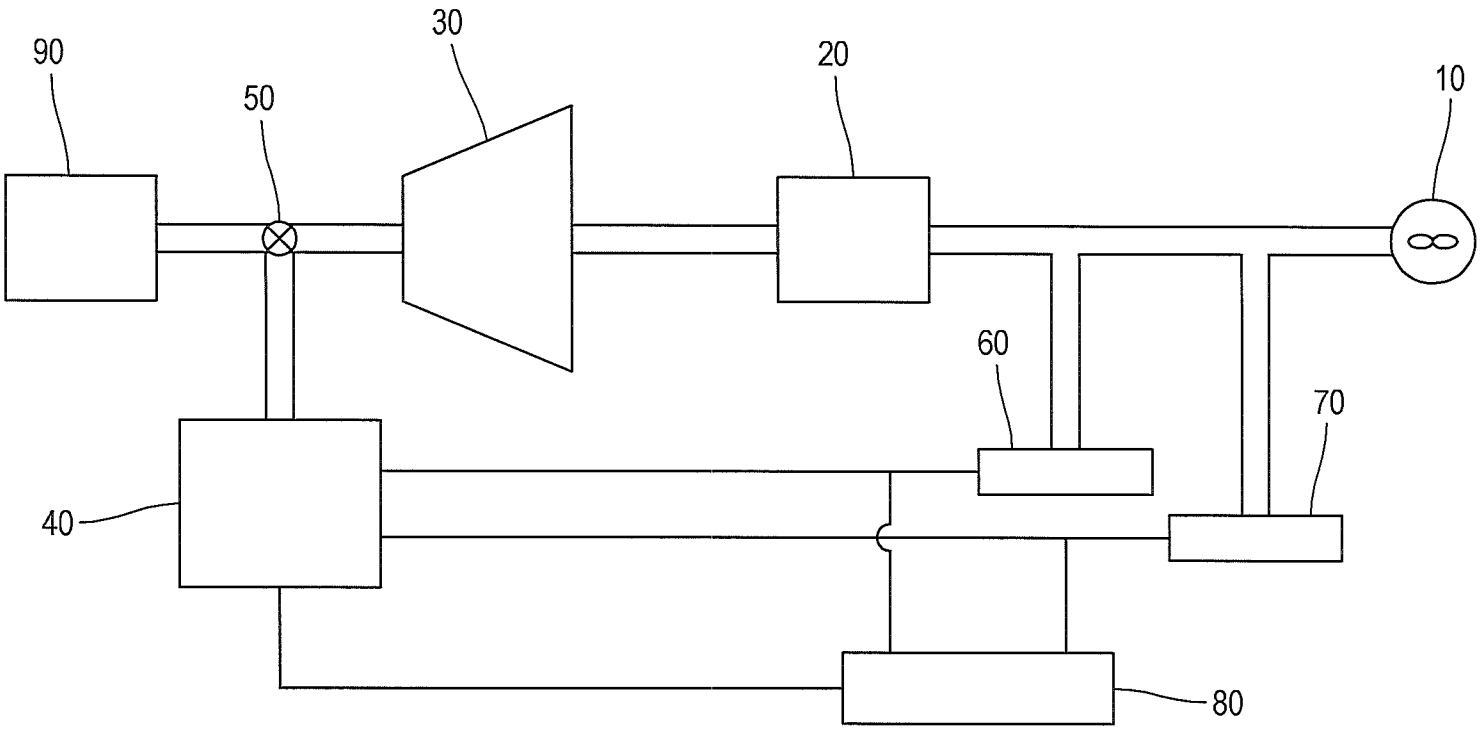
FIG. 1 illustrates a steam turbine governing system according to an embodiment of the invention.

FIG. 1 show an electric generator 20 connected to a steam turbine 30 which is connected to a steam generator 90. The steam generator 90 provides steam to the steam turbine 30 through an arrangement of valves 50. The electric generator 20 is further connected to an electrical grid 10 in order to deliver electrical energy to the consumers through a plurality of transmission lines of the electrical grid 10. The transmission lines of the electrical grid 10, which are not illustrated in FIG. 1, usually use high-voltage three-phase alternating current (AC).

Furthermore, FIG. 1 illustrates an embodiment of a steam turbine governing system for maintaining synchronization between the electrical grid and the electric generator 20 after the occurrence of a grid short circuit. This steam turbine governing system comprises a governor 40 which is connected to means 60 for measuring the voltage drop at the output of the electric generator 20 and to means 70 for measuring the electric power drop at the output of the electric generator 20. The means 60 for measuring the voltage drop is for instance a voltmeter and the means 70 for measuring the power drop is for instance a wattmeter. The means 60 for measuring the voltage drop and the means 70 for measuring the electric power drop are located at the output of the electric generator 20 and they respectively transfer a voltage drop signal and an electric power drop signal to the governor 40. The governor 40 is connected to an arrangement of valves 50 in order to initiate the operation of the latter by means of an actuator in response to a voltage drop exceeding a predetermined value of voltage and to an electric power drop exceeding a predetermined value of electric power. In an embodiment, the arrangement of valves 50 comprises at least a high pressure valve and an intercept pressure valve. Particularly, both the high pressure valve and the intercept pressure valve are located between the steam generator 90 and the steam turbine 30. This particular structure of the arrangement of valves is well known to the person skilled in the art and it is not illustrated in detail in FIG. 1.

In prior art steam turbine governing systems, as already being mentioned in the background art, the initiation of the activation of the arrangement of valves occurs either in response to a measured speed of the steam turbine exceeding a value between 100% and 130% of the synchronization speed or in response to an electric power drop which takes place in case of a load rejection at the output of the electric generator after the occurrence of a grid short circuit.

The steam turbine governing system of the embodiment shown in FIG. 1, allows identifying the occurrence of a grid short circuit at the electrical grid 10 and timely initiating the operation of the arrangement of valves 50. A measurement of a voltage drop exceeding a predetermined value of voltage at the output of the electric generator 20, being further validated by a measurement of an electric power drop exceeding a predetermined value of electric power at the output of the electric generator 20, indicates, in a reliable way the occurrence of a grid short circuit at the output of the electric generator. Advantageously, the initiation of the operation of the arrangement of valves 50 by the governor 40 of the steam turbine governing system of the embodiment shown in FIG. 1, which takes place at the moment of identification of the grid short circuit and particularly when a voltage drop exceeds a predetermined value of voltage and a power drop exceeds a predetermined value of power, is faster than the corresponding initiation performed in the prior art systems. This is because the grid short circuit occurs before the event of the power drop occurring at the output of the electric generator in case of load rejection and also occurs before the event of the increase of the speed of the steam turbine, since the grid short circuit is the cause of the two events. Accordingly, the delay of initiation of operation of the arrangement of valves 50 is significantly reduced in comparison to the delay observed in the prior art steam turbine governing systems and thus the maintenance of synchronization between the electric generator 20 and the electrical grid 10 is ensured.

It is important to note that the predetermined value of voltage and the predetermined value of power are determined by the user of the steam turbine governing system and they both depend on the characteristics of the steam turbine and the generator as well as on the characteristics and the range of the electrical grid.

In an embodiment, the means 60 for measuring the voltage drop at the output of the electric generator 20 comprises a voltage sensor for measuring the voltage drop and provide an output voltage signal proportional to rated nominal voltage as a result of a voltage drop exceeding a predetermined value of voltage. This type of voltage sensors are known to the person skilled in the art. Furthermore, in another embodiment, the means 70 for measuring the electric power drop at the output of the electric generator 20 comprises an electric power sensor for measuring the electric power drop and provide an output electric power signal proportional to rated nominal electric power as a result of an electric power drop exceeding a predetermined value of electric power. This type of electric power sensors is also known to the person skilled in the art.

Preferably, the governor 40 is an electro-hydraulic governor that regulates the steam flow in the steam turbine 30 by controlling an arrangement of valves 50 by means of an actuator in order to maintain synchronization between the electrical grid 10 and the electric generator 20.

Preferably, the initiation of the arrangement of valves 50, and particularly the initiation of a closing action of the latter by the governor 40 in order to reduce the speed of the steam turbine after the occurrence of a grid short circuit, is performed when the governor 40 receives a voltage signal as a result of a voltage drop exceeding a predetermined value between 50% and 90% of the voltage nominal value, and an electric power signal as a result of an electric power drop exceeding a predetermined value between 10% and 30% of the electric power nominal value.

According to another embodiment, the steam turbine governing system further comprises means 80 for measuring the duration of the grid short circuit. The means 80 for measuring the duration of the grid short circuit is preferably a timer that is activated when the voltage drop exceeds the predetermined value of voltage and the power drop exceeds the predetermined value of power at the output of said electrical generator and deactivated when the voltage drop and the power drop are eliminated. Particularly, as illustrated in FIG. 1, the means 80 for measuring the duration of the grid short circuit is connected to both the means 60 for measuring the voltage drop and to the means 70 for measuring the electric power drop at the output of the electric generator 20. The means 80 for measuring the duration of the grid short circuit simultaneously receives a first activation signal from the means 60 when the voltage drop exceeds the predetermined value of voltage and a second activation signal from the means 70 when the electric power drop exceeds the predetermined value of power at the output of the electrical generator 20. These two signals are both transmitted to the means 80 at the moment of the identification of the grid short circuit. At that moment the timer initializes the measurement of the duration of the grid short circuit. When the measured voltage drop and the measured electric power drop at the output of the electric generator 20 are both eliminated (the voltage and the electric power at the output of the electric generator both acquire their rated values), the timer receives a first deactivation signal from the means 60 and a second deactivation signal from the means 70.

The governor 40 is adapted to maintain the closing action of the arrangement of valves 50 proportionally to the duration of the grid short circuit. Particularly, the governor 40 is connected to the timer such that it receives from the latter a signal indicating the duration of the grid short circuit when the measurement of such duration has been completed. Then, the governor 40 multiplies that duration with a coefficient depending on the duration of the grid short circuit and maintains the closing action of the arrangement of valves 50 for a duration equal to the product of that multiplication. Then a command of reopening the arrangement of valves 50 is given by the governor. This multiplication can be performed by means of a microprocessor being integrated to the governor 40. It is important to note that the duration of the grid short circuit depends on the inertia of the steam turbine.

The advantage of maintaining the operation of the arrangement of valves 50 and particularly the closing action of the latter for a duration depending on the duration of the grid short circuit is that only one closing action of the arrangement of valves 50 is required until the speed of the steam turbine acquires a value equal to the synchronization speed after the occurrence of the grid short circuit. In contrast, in the prior art systems, more than one closing action of the arrangement of valves 50 are performed until the speed of the steam turbine acquires a value equal to the synchronization speed.

It is important to note that in the case of short duration (generally considered as less than 60 ms) grid short circuits, the valves 50 may not fully close before the governor commands the reopening of the latter.

Figure 2A:
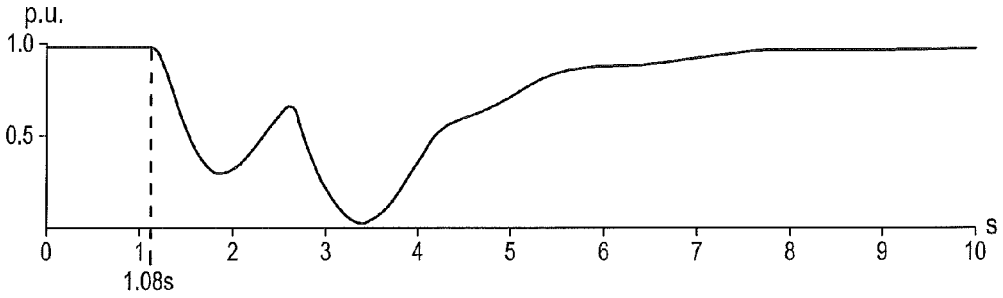
FIG. 2*a* illustrates a diagram of time variation of the mechanical torque of the electric generator according to the steam turbine governing systems of the prior art.
Figure 2B:
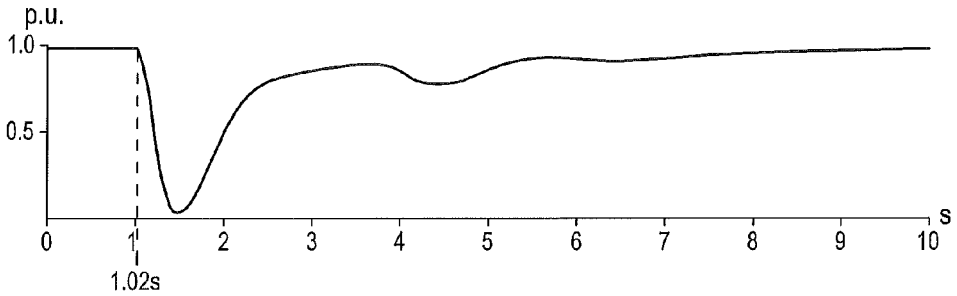
FIG. 2*b* illustrates a diagram of time variation of the mechanical torque of the electric generator according to the steam turbine governing system of the embodiment of FIG. 1.

FIG. 2*a* shows the time variation in seconds of the mechanical torque (per unit) of the electric generator 20 observed in a prior art steam turbine governing system while FIG. 2*b* shows the time variation in seconds of the mechanical torque (per unit) of the electric generator 20 observed in the steam turbine governing system of the invention. It is important to note that a drop of the mechanical torque of the electric generator is a result of a closing action of the arrangement of valves 50 performed for reducing the speed of the steam turbine 30 after the occurrence of the grid short circuit.

Particularly, the mechanical torque of the electric generator in the prior art system (see FIG. 2*a*) presents two drops while the mechanical torque of the electric generator in the system of the invention presents only one drop (see FIG. 2*b*). Also, in FIG. 2*a* the drop of the mechanical torque and thus the initiation of the operation of the arrangement of valves begins at 1.08 seconds after the occurrence of the grid short circuit while in FIG. 2*b* the drop of the mechanical torque begins at 1.02 seconds after the occurrence of the grid short circuit. Thus, the delay of initiating the operation of valves in the system of the invention is less than the corresponding delay in the prior art systems. For the particular example of FIGS. 2*a* and 2*b* the grid short circuit lasts for 80 milliseconds. Also, the initiation of the operation of the arrangement of valves 50 in the example of FIG. 2*b* is performed in response to a voltage drop exceeding a predetermined value of 50% of the voltage nominal value and to an electric power drop exceeding a predetermined value of 10% of the electric power nominal value.

Figure 3:
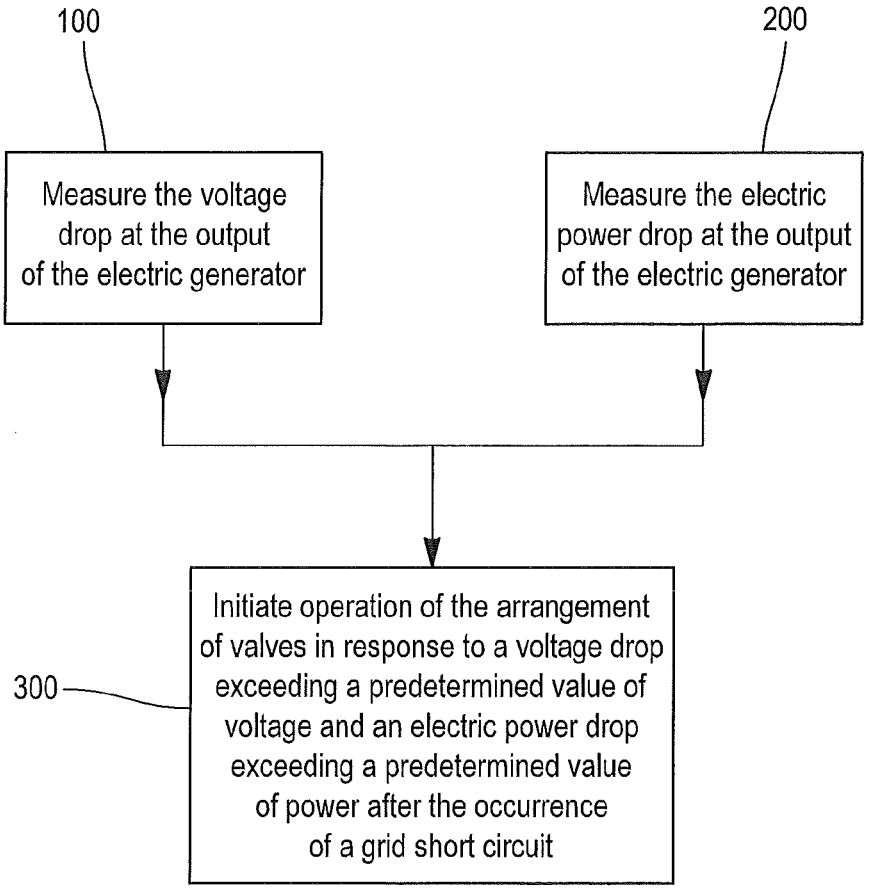
FIG. 3 illustrates a flowchart of a process for maintaining synchronization between an electrical grid and an electric generator after the occurrence of a grid short circuit according to an embodiment of the invention.

FIG. 3 illustrates an embodiment of a process for maintaining synchronization between the electrical grid 10 and the electric generator 20 after the occurrence of a grid short circuit at the electrical grid 10.

In a step 100, the voltage drop is measured at the output of the electric generator by means of the voltage sensor of the steam turbine governing system, and in parallel in a step 200, the electric power drop is measured at the output of the electric generator by means of the electric power sensor of the steam turbine governing system.

In a step 300, the operation of the arrangement of valves 50 is initiated by means of the governor (40) in response to a voltage drop exceeding a predetermined value of voltage and an electric power drop exceeding a predetermined value of electric power at the output of said electrical generator.

Figure 4:
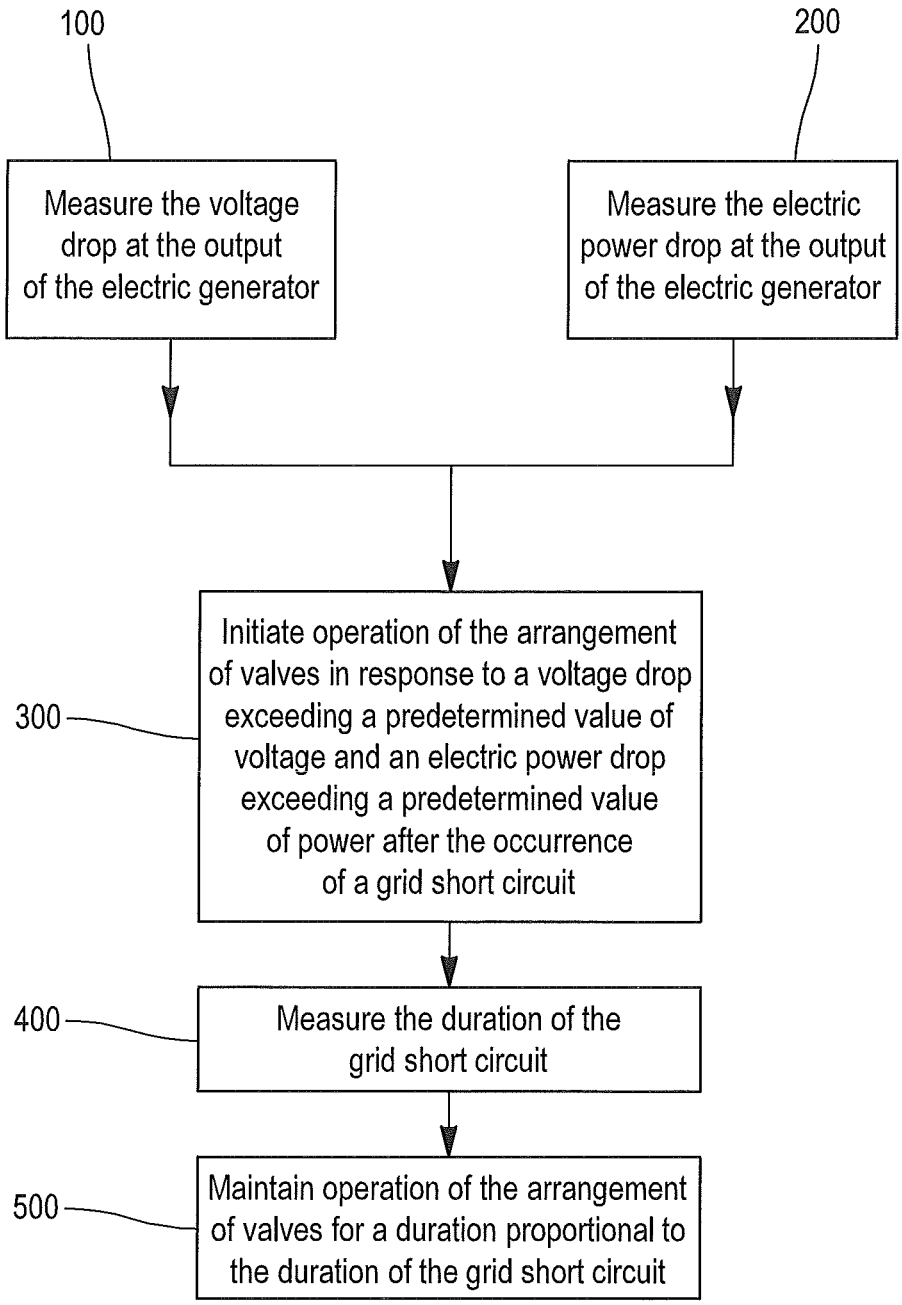
FIG. 4 illustrates a flowchart of a process for maintaining synchronization between an electrical grid and an electric generator after the occurrence of a grid short circuit according to another embodiment of the invention.

According to another embodiment, the process further comprises a step 400 of measuring the duration of the grid short circuit by a timer and a step 500 of maintaining operation of the arrangement of valves of the steam turbine by the governor 40 for a duration depending on the duration of the grid short circuit (see FIG. 4).

The measurement of the duration of the grid short circuit, as described above, is achieved by activating the means 80 for measuring the duration of the grid short circuit when the voltage drop exceeds the predetermined value of voltage and the power drop exceeds the predetermined value of power at the output of said electrical generator and deactivating the means 80 when the voltage drop and the power drop are eliminated.

The invention claimed is:

1. A steam turbine governing system for maintaining synchronization between an electrical grid and an electric generator after the occurrence of a grid short circuit at the electrical grid, said electric generator driven by a steam turbine, said steam turbine governing system comprising:

a governor adapted to control a valve arrangement for regulating steam flow in the steam turbine;

means for measuring voltage drop at an output of the electric generator;

means for measuring electric power drop at the output of the electric generator, with the governor connected to the means for measuring the voltage drop and the means for measuring the electric power drop, and operable to initiate operation of the valve arrangement in response to the voltage drop exceeding a predetermined value of voltage at the output of the electric generator and in response to the electric power drop exceeding a predetermined value of electric power at the output of the electric generator, to maintain synchronization between the electrical grid and the electric generator after the occurrence of the grid short circuit at the electrical grid; and measuring means for measuring duration of the grid short circuit, the measuring means operable for activation when the voltage drop exceeds the predetermined value of voltage at the output of the electric generator and the power drop exceeds the predetermined value of electric power at the output of said electric generator, and the measuring means operable for deactivation when the voltage drop and the electric power drop are eliminated.

2. The steam turbine governing system according to claim 1, wherein the valve arrangement of the steam turbine is operated for a duration proportional to the duration of the grid short circuit as measured by the measuring means.

3. The steam turbine governing system according to claim 1, wherein the governor is operable to maintain operation of the valve arrangement for a duration dependent upon the grid short circuit duration.

4. The steam turbine governing system according to claim 1, wherein the valve arrangement comprises at least a high pressure valve and an intercept pressure valve.

5. A process for maintaining synchronization between an electrical grid and an electric generator after occurrence of a grid short circuit at the electrical grid, said electric generator driven by a steam turbine, said process comprising:

measuring voltage drop at an output of the electric generator;

measuring in parallel electric power drop at the output of the electric generator;

measuring duration of the grid short circuit with measuring means operable for activation when the voltage drop exceeds the predetermined value of voltage at the output of the electric generator and the power drop exceeds the predetermined value of electric power at the output of said electric generator, and the measuring means operable for deactivation when the voltage drop and the electric power drop are eliminated; and initiating operation of a valve arrangement regulating steam flow in the steam turbine in response to voltage drop exceeding a predetermined value of voltage at the output of the electric generator and electric power drop exceeding a predetermined value of electric power at the output of said electrical generator after the occurrence of the grid short circuit to maintain synchronization between the electrical grid and the electric generator.

6. The process according to claim 5, further comprising:

maintaining operation of the valve arrangement of the steam turbine for a duration proportional to the duration of the grid short circuit.

7. The process according to claim 5, wherein the valve arrangement comprises at least a high pressure valve and an intercept pressure valve.

* * * * *